US006266823B1

(12) United States Patent
Padoan

(10) Patent No.: US 6,266,823 B1
(45) Date of Patent: Jul. 31, 2001

(54) TIE WITH CONCEALED POCKETS

(76) Inventor: Corrado Padoan, Via Faruffini, 20, 20149 Milan (IT)

( * ) Notice: Subject to any disclaimer, the term of this patent is extended or adjusted under 35 U.S.C. 154(b) by 0 days.

(21) Appl. No.: 09/531,008

(22) Filed: Mar. 20, 2000

Related U.S. Application Data

(63) Continuation of application No. PCT/EP98/05754, filed on Sep. 9, 1998.

(30) Foreign Application Priority Data

Sep. 22, 1997 (IT) ..... MI97A2140

(51) Int. Cl.[7] ..... A41D 25/00
(52) U.S. Cl. ..... 2/144
(58) Field of Search ..... 2/144, 145, 146, 2/155, 156, 157, 247, 248, 249, 250, 252, 253, 254; D2/602, 605

(56) References Cited

U.S. PATENT DOCUMENTS

D. 180,467 * 6/1957 Bergheim ..... D3/16
D. 264,892 * 6/1982 Stewart, Jr. et al. ..... D2/343
D. 351,491 * 10/1994 Just ..... D2/605
D. 378,007 * 2/1997 Dean ..... D2/609
D. 393,137 * 4/1998 Breton ..... D2/605
517,769 * 4/1894 Selowsky ..... 2/144
1,363,243 * 12/1920 Forman ..... 2/144
2,019,782 * 11/1935 Gray ..... 2/145
2,076,908 * 4/1937 Miles ..... 2/146
2,082,447 * 6/1937 Gold ..... 2/146
2,275,682 * 3/1942 Rantz ..... 2/157
3,842,436 * 10/1974 Hirschson ..... 2/157
4,085,872 * 4/1978 Foo ..... 224/5 D
4,835,821 * 6/1989 Durante ..... 24/49
4,843,644 * 7/1989 Sugarman ..... 2/46
5,802,613 * 9/1998 Marshall ..... 2/145
5,806,098 * 9/1998 McKinnon et al. ..... 2/145
5,881,383 * 3/1999 Perkins ..... 2/144

* cited by examiner

*Primary Examiner*—John J. Calvert
*Assistant Examiner*—Alissa L. Hoey
(74) *Attorney, Agent, or Firm*—Guido Modiano; Albert Josif; Daniel J. O'Byrne

(57) ABSTRACT

A tie with means for supporting documents, credit cards, bills and objects in general, comprising, at an internal portion of the front apron, at least one compartment which can be accessed by means of at least one opening and can be closed by the lateral flaps of the front apron, which are folded onto the internal central portion of the front apron.

7 Claims, 2 Drawing Sheets

TIE WITH CONCEALED POCKETS

CROSS-REFERENCE TO RELATED APPLICATIONS

This application is a continuation of application number PCT/EP98/05754 filed on Sep. 9, 1998.

BACKGROUND OF THE INVENTION

The present invention relates to a tie with means for supporting documents, credit cards, bills and objects in general.

It is known that a problem that is currently felt is the efficient utilization of every space and the concealment of documents, credit cards, bills and other personal items of value, keeping them in the most controllable position available and allowing to eliminate, where allowed by circumstances, the uncomfortable and anaesthetic bulk of a wallet.

In order to solve this problem, ties have already been studied which provide for the addition of simple pockets which are closed by means of conventional toothed zip fasteners or similar elements. This solution has not proved to be valid from a practical point of view, since said pockets produce a considerable bulge which alters the classic line of a tie and are also difficult to use owing to the difficulty in inserting and removing the contents, since both operations force one to fully unfold the tie.

An example of such pockets, closed by a clip is disclosed in CA-A-2129357.

U.S. Pat. No. 5435011 discloses a necktie with pockets, as claimed in the preamble of claim 1.

SUMMARY OF THE INVENTION

The aim of the present invention is to solve the above by providing a tie with means for supporting documents, credit cards, bills and objects in general which allows to apply, to a tie having a conventional line, elements which allow to contain and protect documents, credit cards, bills and other items, preferably having a flat configuration, without altering the conventional line of a tie.

Within the scope of this aim, a particular object of the present invention is to provide a tie in which it is possible to provide a plurality of regions preset for containing individual elements so as to avoid encumbering the aesthetic line of the tie and to make the presence of the elements, retained in a concealed position, undetectable from outside.

Another object of the present invention is to provide a tie which, by virtue of its particular constructive characteristics, is capable of giving the greatest assurances of reliability and safety in use.

Another object of the present invention is to provide a tie which can be easily obtained starting from commonly commercially available elements and materials and is also competitive from a merely economical point of view.

This aim, these objects and others which will become apparent hereinafter are achieved by a tie with means for supporting documents, credit cards, bills and objects in general, according to the invention, as claimed in the appended claims.

BRIEF DESCRIPTION OF THE DRAWINGS

Further characteristics and advantages of the present invention will become apparent from the following detailed description of a preferred but not exclusive embodiment of a tie with means for supporting documents, credit cards, bills and objects in general, illustrated only by way of non-limitative example in the accompanying drawings, wherein.

DESCRIPTION OF THE PREFERRED EMBODIMENTS

Figure 1:
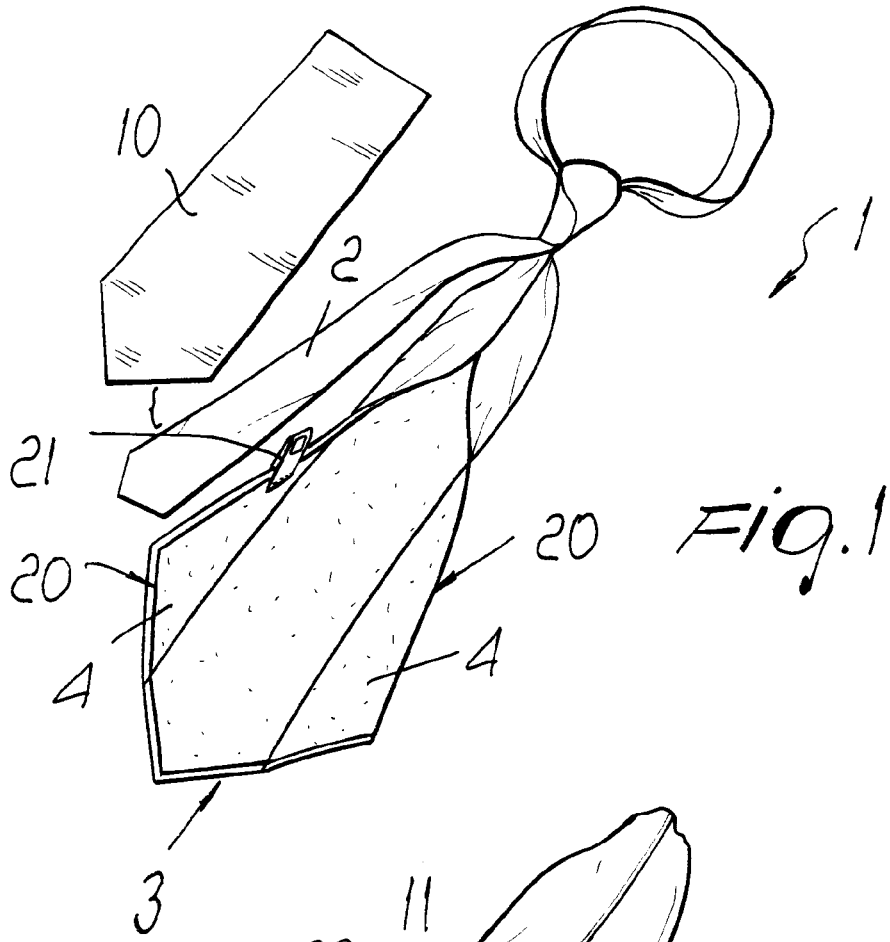
FIG. 1 is a schematic perspective view of a tie according to the present invention, illustrating in an exploded view an internal layer which can be applied to the internal central portion of the front apron.
Figure 2:
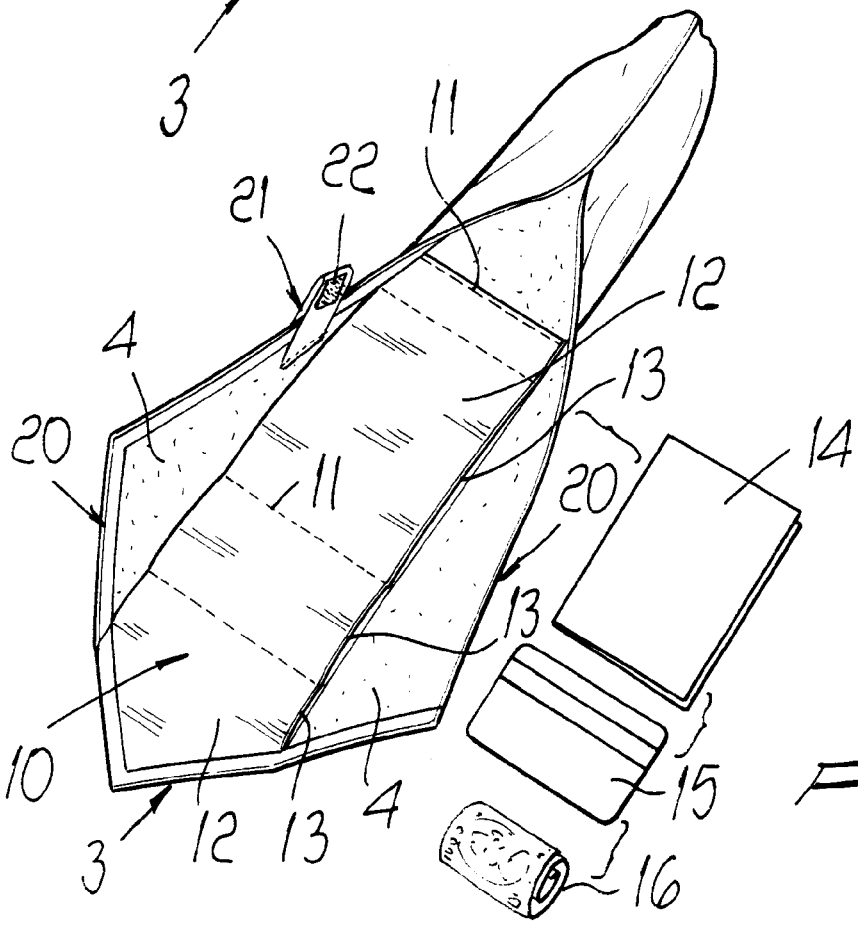
FIG. 2 is a schematic perspective view of a front apron of the tie, with the internal layer applied thereto.
Figure 3:
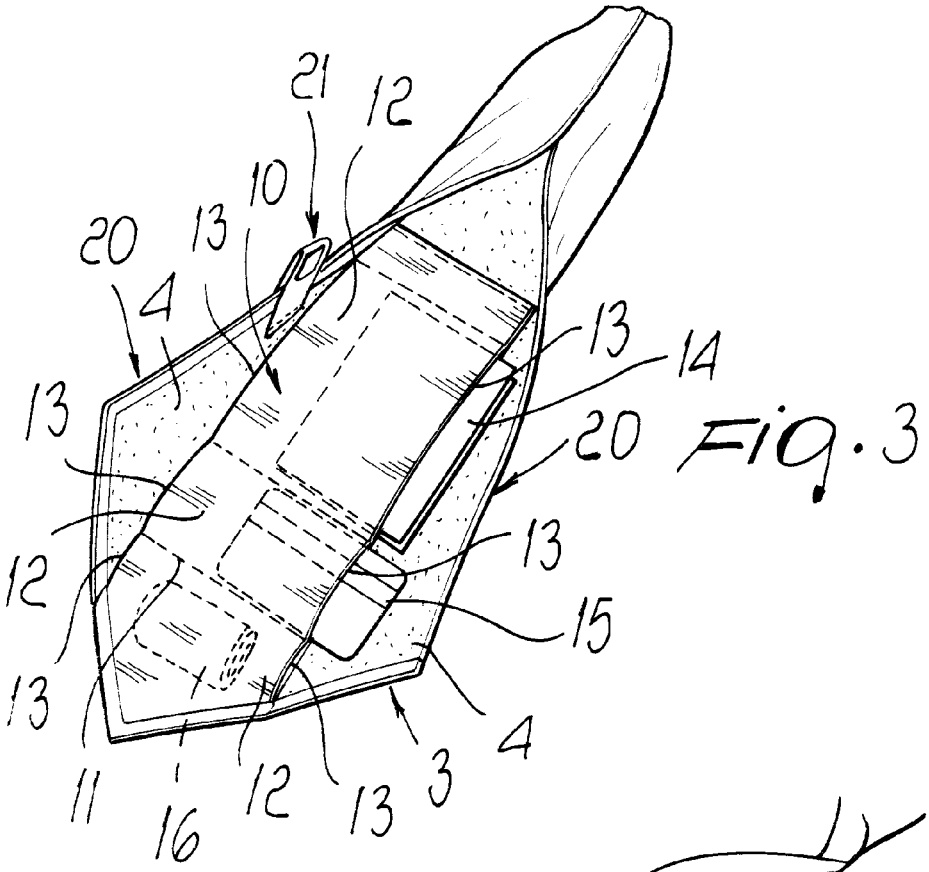
FIG. 3 is a schematic perspective view of the step for the insertion of documents, credit cards and bills in the compartments formed inside the front apron.
Figure 4:
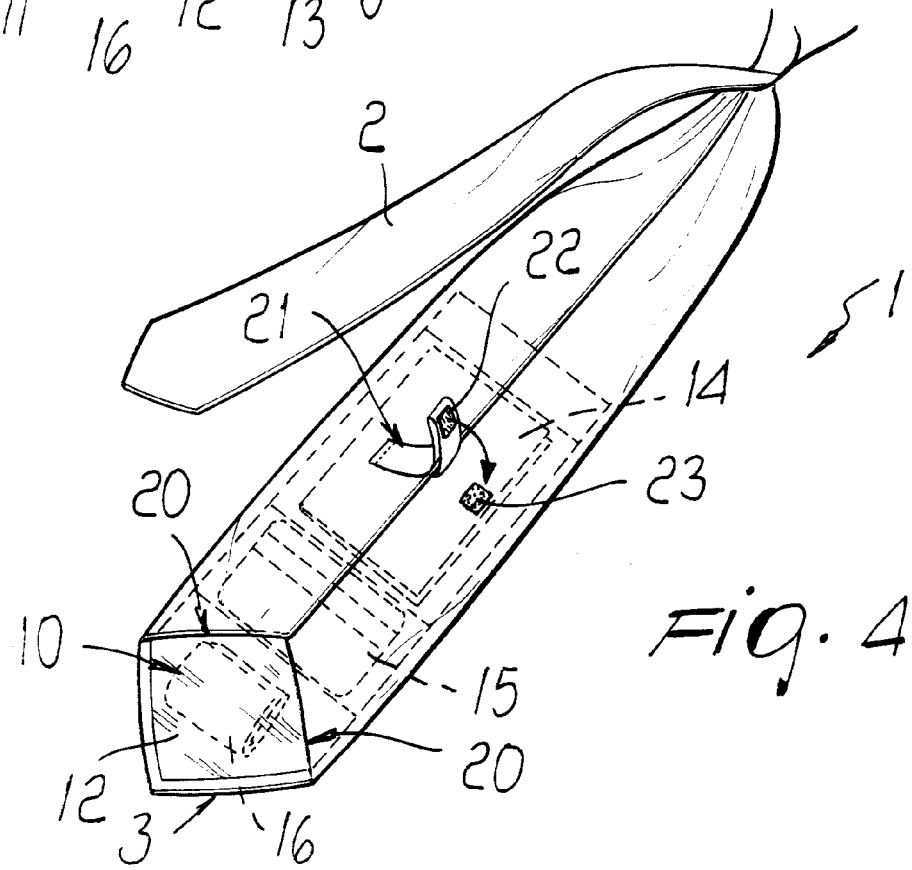
FIG. 4 is a schematic perspective view of the tie in the position for use, illustrating the step for the closure of the flaps.

With reference to the above figures, the tie with means for supporting documents, credit cards, bills and objects in general, generally designated by the reference numeral 1, is provided, in a per se conventional manner, by means of a strip of fabric 2 which can be of any kind and bear any image, coloring or design.

The tie 1 forms a front apron 3, i.e., the wider end portion that remains exposed, inside which an internal lining 4 and an optional tie reinforcement element are advantageously applied in a per se known manner.

The particular characteristic of the invention is constituted by the fact that an internal layer 10 is applied at the central internal portion of the front apron and is connected by means of a plurality of seams 11 which form a plurality of compartments 12 between the internal layer 10 and the internal portion of the front apron constituted by the lining 4.

The compartments 12 have the particularity that they have openings 13 which are advantageously arranged laterally; preferably, two mutually opposite openings 13 are provided for each compartment 12.

The compartments 12 are formed by the seams 11, which are perpendicular to the longitudinal extension of the tie, so that the openings 13, which are formed by the unstitched portions of the internal layer 10, are arranged laterally on both sides.

The compartments 12 can be advantageously sized so as to contain documents 14, credit cards 15, bills 16 or similar elements, preferably having a flat shape.

An important particularity of the invention is constituted by the fact that the openings 13 are of course closed by the lateral flaps 20 of the front apron 3 when said flaps are folded over the central portion where the internal layer 10 is provided.

In this manner, the individual compartments are closed by utilizing the typical configuration of the tie.

Advantageously, in order to maintain the closed position, a tab 21 is connected on one flap 20 and is provided with a tear-open tape 22 which couples to a corresponding portion of tear-open tape 23 provided on the opposite flap.

The tab 21 in practice constitutes the ordinary label with the name of the manufacturer of the tie.

In this case, the tab also acts as a stabilization and closure element for the tie, thus obtaining an assembly in which the elements inserted in the compartments 12 are safely protected while being easily accessible to the user, who with a simple gesture can open the tab 21 and access the compartments 12 from the left or from the right according to personal preferences.

From the above description it is thus evident that the invention achieves the intended aim and objects, and in particular the fact is stressed that a tie is provided with means for supporting documents, credit cards, bills and objects in general which, although having a fully conventional appearance, has a considerable functionality, since it provides compartments which can be closed simply by utilizing the typical shape of a tie.

Another aspect is further constituted by the fact that in order to provide the tie according to the invention it is sufficient to apply the internal layer that forms the various compartments to a conventional tie.

The invention thus conceived is susceptible of numerous modifications and variations, all of which are within the scope of the inventive concept.

All the details may also be replaced with other technically equivalent elements.

In practice, the materials employed, as well as the contingent shapes and dimensions, may be any according to requirements.

What is claimed is:

1. A tie with means for supporting documents, credit cards, bills and objects in general, comprising, at an internal central portion of a front apron of the tie, at least one compartment which can be accessed by means of at least one opening which can be closed by at least one lateral flap of said front apron which is folded onto the internal central portion of said front apron, wherein said at least one opening is accessed laterally with respect to a longitudinal extension of said tie, said at least one opening being vertically arranged at a folding edge of said at least one lateral flap so that said at least one lateral flap when folded onto said internal central portion of the flap at the same time closes said at least one opening.

2. The tie according to claim 1, comprising two mutually opposite openings for each compartment.

3. The tie according to claim 1, wherein said at least one compartment is formed by an internal layer applied to the internal face of said front apron.

4. The tie according to claim 3, wherein said at least one compartment is delimited by seams that stitch said internal layer to the internal portion of said front apron.

5. The tie according to claim 1, comprising a plurality of compartments which are delimited by seams which run in a direction substantially perpendicular to the longitudinal extension of said tie.

6. The tie according to claim 1, comprising, at one of said lateral flaps, a tab provided with means for closing onto the opposite lateral flap.

7. The tie according to claim 6, wherein said means for closing onto the opposite lateral flap are constituted by portions of tear-open tape.

* * * * *